US010598074B2

(12) United States Patent
Kato et al.

(10) Patent No.: US 10,598,074 B2
(45) Date of Patent: Mar. 24, 2020

(54) EXHAUST DEVICE OF MULTIPLE-CYLINDER ENGINE

(71) Applicant: MAZDA MOTOR CORPORATION, Hiroshima (JP)

(72) Inventors: Jiro Kato, Kure (JP); Tatsuya Koga, Higashihiroshima (JP); Shinji Sumi, Hiroshima (JP); Haruna Yanagida, Hiroshima (JP); Norihisa Murata, Hiroshima (JP)

(73) Assignee: MAZDA MOTOR CORPORATION, Hiroshima (JP)

( * ) Notice: Subject to any disclaimer, the term of this patent is extended or adjusted under 35 U.S.C. 154(b) by 108 days.

(21) Appl. No.: 15/761,206

(22) PCT Filed: Nov. 9, 2016

(86) PCT No.: PCT/JP2016/083290
§ 371 (c)(1),
(2) Date: Mar. 19, 2018

(87) PCT Pub. No.: WO2017/090433
PCT Pub. Date: Jun. 1, 2017

(65) Prior Publication Data

US 2018/0266302 A1 Sep. 20, 2018

(30) Foreign Application Priority Data

Nov. 25, 2016 (JP) ..... 2015-229584

(51) Int. Cl.
*F01N 13/10* (2010.01)
*F02B 27/04* (2006.01)

(52) U.S. Cl.
CPC ..... *F01N 13/10* (2013.01); *F02B 27/04* (2013.01)

(58) Field of Classification Search
CPC ..... F01N 13/10; F02B 27/04
See application file for complete search history.

(56) References Cited

U.S. PATENT DOCUMENTS 6,027,146 A 2/2000 Kurimoto
6,647,714 B1 11/2003 Gerber
2011/0154812 A1* 6/2011 Butler ..... F01N 13/08 60/324

FOREIGN PATENT DOCUMENTS

CN 203009031 U 6/2013
JP S57-086515 A 5/1982
(Continued)

OTHER PUBLICATIONS

An Office Action: "Notification of Reasons for Refusal" issued by the Japanese Patent Office dated Dec. 26, 2017, in connection with Japanese Patent Application No. 2015-229584.
(Continued)

*Primary Examiner* — Brandon D Lee
(74) *Attorney, Agent, or Firm* — Studebaker & Brackett PC

(57) ABSTRACT

Provided is an exhaust device connected to an engine body. The exhaust device includes a plurality of independent exhaust pipes, each of which has a circular cross section, and which are connected to exhaust ports of cylinders of the engine body; and a mixing pipe having a circular cross section, connected to downstream ends of the independent exhaust pipes, and through which exhaust gas that has passed through the independent exhaust pipes flows in. The independent exhaust pipes are connected to an upstream end of the mixing pipe in such a manner that parts of internal spaces of the circular cross sections overlap each other in a predetermined section from the downstream ends of the independent exhaust pipes toward upstream, and a ratio of
(Continued)

overlapping portions of the circular cross sections gradually increases from upstream toward downstream.

4 Claims, 27 Drawing Sheets

(56) References Cited

FOREIGN PATENT DOCUMENTS

| | | | |
|---|---|---|---|
| JP | S60-046248 | B2 | 10/1985 |
| JP | S61-160512 | A | 7/1986 |
| JP | H09-296724 | A | 11/1997 |
| JP | 2013-032753 | A | 2/2013 |
| JP | 2013-079609 | A | 5/2013 |

OTHER PUBLICATIONS

International Search Report issued in PCT/JP2016/083290; dated Jan. 31, 2017.

An Office Action issued by the Chinese Patent Office dated Sep. 25, 2019, which corresponds to Chinese Patent Application No. 201680053703.8 and is related to U.S. Appl. No. 15/761,206; with English language summary.

* cited by examiner

EXHAUST DEVICE OF MULTIPLE-CYLINDER ENGINE

TECHNICAL FIELD

The present invention relates to an exhaust device of a multiple cylinder engine.

BACKGROUND ART

Conventionally, in an engine for an automobile or the like, development of an exhaust device for the purpose of enhancing engine output is carried out. Patent Literature 1 discloses an example of the exhaust device. An exhaust device described in Patent Literature 1 includes a plurality of independent exhaust pipes respectively connected to exhaust ports of a plurality of cylinders, in which exhaust operations are not performed consecutively; and a mixing pipe having a circular cross section, connected to downstream ends of the independent exhaust pipes, and through which exhaust gas that has passed through the independent exhaust pipes flows in, wherein cross-sectional shapes of the downstream ends of the independent exhaust pipes are fan shapes identical to each other, and the downstream ends of the independent exhaust pipes are connected to an upstream end of the mixing pipe in a state that the independent exhaust pipes are gathered in such a manner that the fan shapes are formed into a circular shape.

According to the exhaust device, a negative pressure is generated within the mixing pipe when exhaust gas that has passed through the independent exhaust pipes flows into the mixing pipe. An ejector effect such that exhaust gas within other one of the independent exhaust pipes and within an exhaust port of a cylinder communicating with the other one of the independent exhaust pipes is sucked downstream by the negative pressure. Further, exhaust gas from the cylinder is promoted by the ejector effect, and engine output is enhanced.

However, in the exhaust device described in Patent Literature 1, exhaust gas flows into the mixing pipe having a circular cross section from the cross-sectional fan-shaped downstream ends of the independent exhaust pipes. Therefore, it is difficult to uniformly distribute exhaust gas flowing in through the independent exhaust pipes within the mixing pipe. Consequently, backflow of exhaust gas is likely to occur within the mixing pipe, and a suction amount of exhaust gas from the independent exhaust pipes may not be sufficiently secured.

CITATION LIST

Patent Literature

Patent Literature 1: Japanese Unexamined Patent Publication No. 2013-79609

SUMMARY OF INVENTION

In view of the above, an object of the present invention is to provide an exhaust device of an engine, which enables to enhance engine output by utilizing an ejector effect, with an improvement of increasing a suction amount of exhaust gas from an independent exhaust pipe.

The present invention is directed to an exhaust device connected to an engine body of an engine having a plurality of cylinders. The exhaust device includes a plurality of independent exhaust pipes, each of which has a circular cross section, the independent exhaust pipes being respectively connected to exhaust ports of the cylinders of the engine body or to exhaust ports of ones of the plurality of cylinders, in which exhaust operations are not performed consecutively; and a mixing pipe having a circular cross section, connected to downstream ends of the independent exhaust pipes, and through which exhaust gas that has passed through the independent exhaust pipes flows in. The independent exhaust pipes are connected to an upstream end of the mixing pipe in such a manner that parts of inner spaces of the circular cross sections overlap each other in a predetermined section from the downstream ends of the independent exhaust pipes toward upstream, and a ratio of overlapping portions of the circular cross sections gradually increases from upstream toward downstream.

DESCRIPTION OF EMBODIMENTS

In the following, preferred embodiments of the present invention will be described in detail with reference to the accompanying drawings.

First Embodiment

Figure 1:
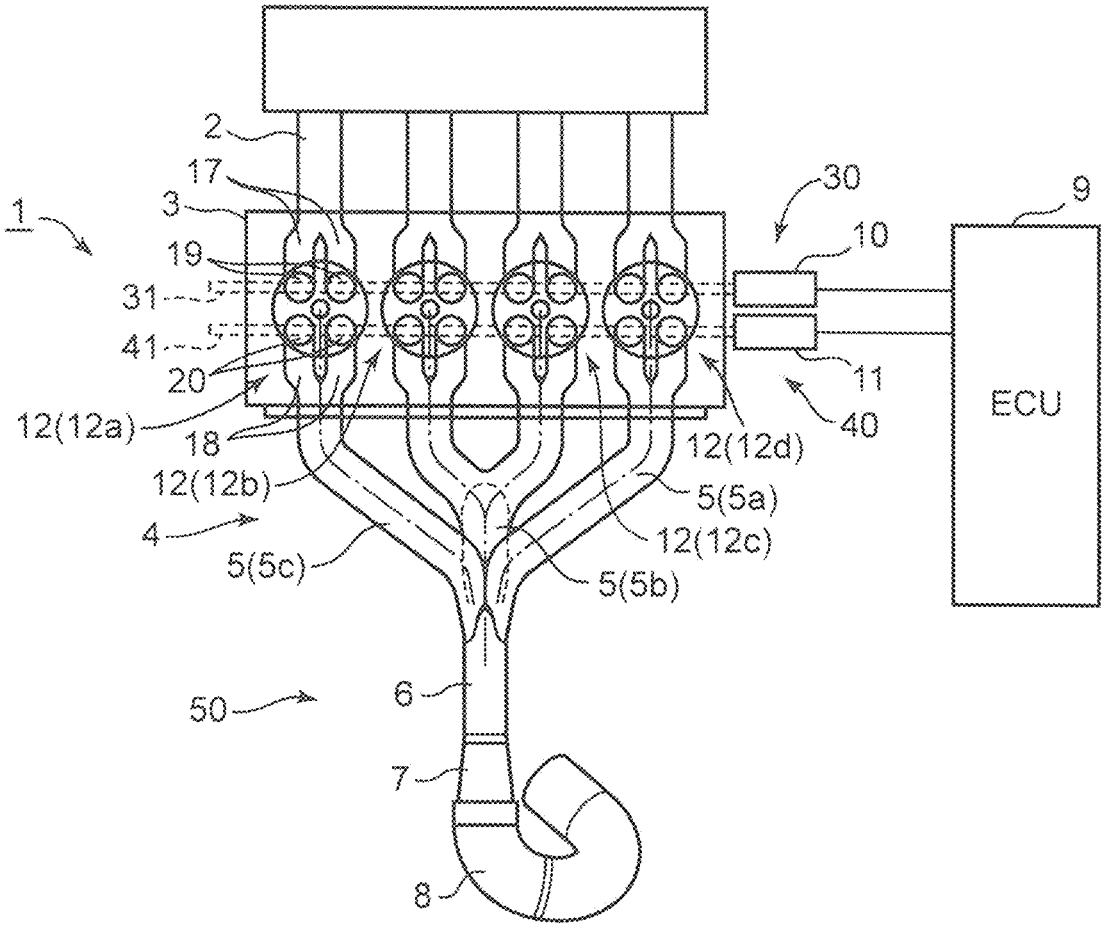
FIG. 1 is an overall schematic diagram of an exhaust device of an engine according to a first embodiment of the present invention.

The present invention is applied to an engine illustrated in FIG. 1.

The engine includes an engine body 1 having a cylinder head 3 and a cylinder block (not illustrated), a plurality of intake pipes 2 connected to the engine body 1, an exhaust manifold 4 connected to the engine body 1, a downstream exhaust pipe 8 connected to the exhaust manifold 4, and an engine control unit (ECU) 9. In the embodiment, the exhaust manifold 4 corresponds to an exhaust device of the present invention.

A plurality of cylinders 12, in each of which a piston is placed, are formed within the cylinder head 3 and the cylinder block. The engine (engine body 1) according to the embodiment is an in-line 4-cylinder engine. Four cylinders 12 are formed within the cylinder head 3 and the cylinder block in an arrayed state. Specifically, a first cylinder 12*a*, a second cylinder 12*b*, a third cylinder 12*c*, and a fourth cylinder 14*d* are formed in this order from the left side in FIG. 1 (hereinafter, unless otherwise specifically required to distinguish the cylinders one from another, the cylinders may be referred to as "cylinders 12"). A spark plug is disposed within the cylinder 3 in such a manner that each spark plug faces within a combustion chamber formed above each piston.

Figure 9:
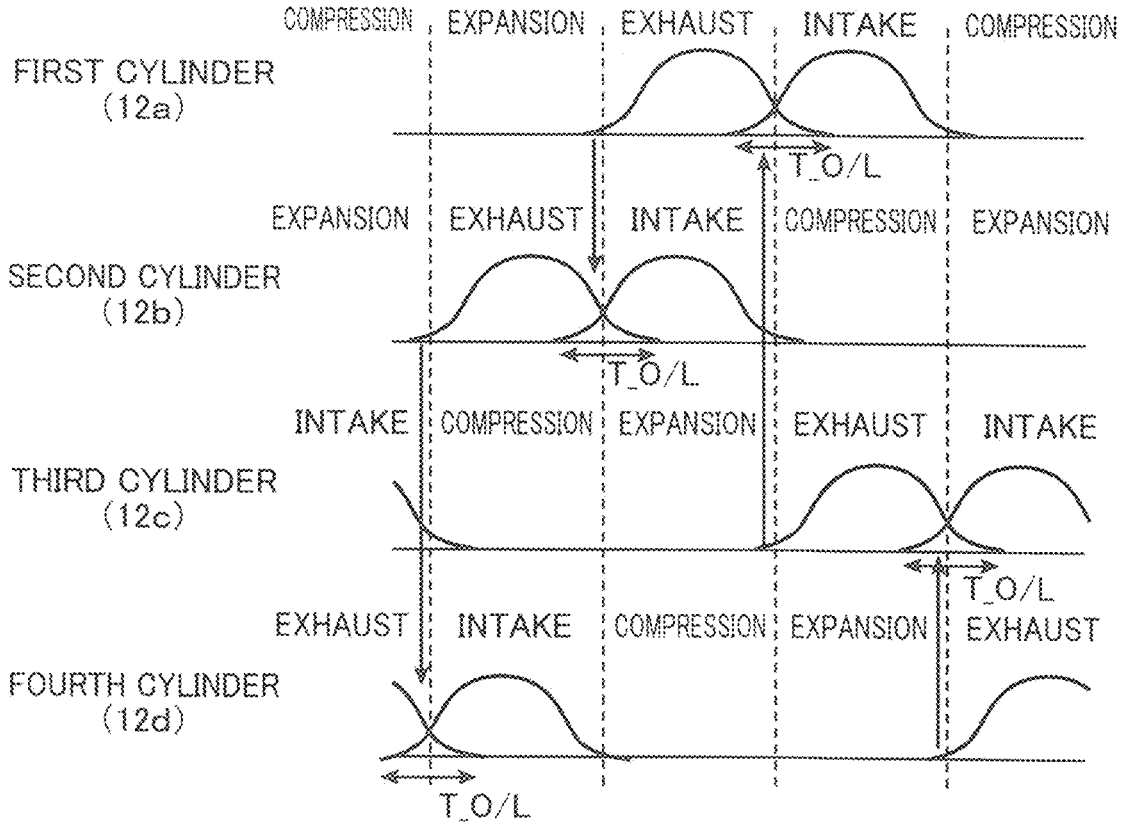
FIG. 9 is a diagram illustrating intake and exhaust timings of the engine.

The engine body 1 is a 4-cycle engine. As illustrated in FIG. 9, the engine body 1 is configured such that ignition by the spark plug is performed in the cylinders 12*a* to 12*d* at a timing displaced each by 180° CA. In other words, the engine body 1 is configured such that an intake stroke, a compression stroke, an expansion stroke, and an exhaust stroke are respectively performed at a timing displaced each by 180° CA. In the embodiment, ignition is performed in the order of the first cylinder 12*a*→the third cylinder 12*c*→the fourth cylinder 12*d*→the second cylinder 12*b*.

Two intake ports 17 and two exhaust ports 18, each of which is opened toward a combustion chamber, are formed in an upper portion of each of the cylinders 12*a* to 12*d*. The intake ports 17 are formed to introduce intake air into each cylinder 12. The exhaust ports 18 are formed to discharge exhaust gas from each cylinder 12. An intake valve 19 for communicating between the intake port 17 and the inside of the cylinder 12, or blocking communication by opening or closing the intake port 17 is provided for each of the intake ports 17. An exhaust valve 20 for communicating between the exhaust port 18 and the inside of the cylinder 12, or blocking communication by opening or closing the exhaust port 18 is provided for each of the exhaust ports 18. The intake valve 19 opens and closes the intake port 17 at a predetermined timing when being driven by an intake valve drive mechanism 30. Further, the exhaust valve 20 opens and closes the exhaust port 18 at a predetermined timing when being driven by an exhaust valve drive mechanism 40.

The intake valve drive mechanism 30 includes an intake camshaft 31 which comes into contact with the intake valve 19, and an intake-side variable valve timing mechanism 10. The intake camshaft 31 is connected to a crankshaft via a power transmission mechanism such as a well-known chain/sprocket mechanism, and drives to open and close the intake valve 19 when being rotated in accordance with rotation of the crankshaft.

The intake-side variable valve timing mechanism 10 is configured to change a valve timing of the intake valve 19. The intake-side variable valve timing mechanism 10 changes a phase difference between a predetermined driven shaft which is disposed coaxially with the intake camshaft 31 and is directly driven by the crankshaft, and the intake camshaft 31. Thus, the intake-side variable valve timing mechanism 10 changes a valve timing of the intake valve 19 by changing a phase difference between the crankshaft and the intake camshaft 31. The intake-side variable valve timing mechanism 10 changes the phase difference, based on a target valve timing of the intake valve 19, which is calculated by the ECU 9.

The exhaust valve drive mechanism 40 has a same structure as the intake valve drive mechanism 30. Specifically, the exhaust valve drive mechanism 40 includes an exhaust camshaft 41 which comes into contact with the exhaust valve 20, and which is connected to the crankshaft; and an exhaust-side variable valve timing mechanism 11 for changing a valve timing of the exhaust valve 20 by changing a phase difference between the exhaust camshaft 41 and the crankshaft. The exhaust-side variable valve timing mechanism 11 changes the phase difference, based on a target valve timing of the exhaust valve 20, which is calculated by the ECU 9. Further, the exhaust camshaft 41 drives the exhaust valve 20 to open and close at the target valve timing when being rotated in accordance with rotation of the crankshaft with the phase difference.

Next, target valve timings of the intake valve 19 and the exhaust valve 20 are described.

Target valve timings of the intake valve 19 and the exhaust valve 20 are set such that, in a predetermined operation range (e.g. an all-operation range, a range where an engine speed is equal to or lower than a predetermined reference speed, a low-speed high-load range, or the like), a valve opening period of the exhaust valve 20 and a valve opening period of the intake valve 19 of each cylinder 12 overlap with respect to an intake top dead center (TDC); and regarding the cylinders 12 and 12, in which exhaust operations are consecutively performed, the exhaust valve 20 of the other (succeeding cylinder) of the cylinders 12 starts to open during an overlap period T_O/L when a valve opening period of one (preceding cylinder) of the cylinders 12 and a valve opening period of the other of the cylinders 12 overlap. More specifically, as illustrated in FIG. 9, target valve timings are set in such a manner that the exhaust valve 20 of the third cylinder 12*c* is started to open during a period when a valve opening period of the exhaust valve 20 and a valve opening period of the intake valve 19 of the first cylinder 12*a* overlap; the exhaust valve 20 of the fourth cylinder 12*d* is started to open during a period when a valve opening period of the exhaust valve 20 and a valve opening period of the intake valve 19 of the third cylinder 12*c* overlap; the exhaust valve 20 of the second cylinder 12*b* is started to open during a period when a valve opening period of the exhaust valve 20 and a valve opening period of the intake valve 19 of the fourth cylinder 12*d* overlap; and the exhaust valve 20 of the first cylinder 12*a* is started to open during a period when a valve opening period of the exhaust valve 20 and a valve opening period of the intake valve 19 of the second cylinder 12*b* overlap.

The intake ports 17 of the cylinders 12*a* to 12*d* are respectively connected to the intake pipes 2 on the upstream side of the cylinders 12*a* to 12*d*. Specifically, four intake pipes 2 are provided in correspondence to the number of cylinders. Two intake ports 17 formed in each cylinder 12 are connected to one intake pipe 2.

The exhaust manifold 4 includes, in this order from the upstream side thereof, three independent exhaust pipes 5, and a mixing pipe 50 connected to downstream ends of the independent exhaust pipes 5 and through which exhaust gas that has passed through the independent exhaust pipes 5 flows in. The mixing pipe 50 includes, on an axis thereof, a straight portion 6 (corresponding to a "gathering portion" of the present invention) extending downstream, and a diffuser portion 7 configured such that a flow channel area thereof increases toward downstream side in this order from the upstream side thereof. In other words, downstream ends of the independent exhaust pipes 5 are connected to an upstream end of the straight portion 6.

Upstream ends of the independent exhaust pipes 5 are connected to the exhaust ports 18 of the cylinders 12*a* to 12*d*. Specifically, the exhaust ports 18 of the first cylinder 12*a* and the exhaust ports 18 of the fourth cylinder 12*d* are respectively and individually connected to an independent exhaust pipe 5*a* and to an independent exhaust pipe 5*c*. On the other hand, exhaust gas is not simultaneously discharged from cylinders regarding the exhaust ports 18 of the second cylinder 12*b* and the exhaust ports 18 of the third cylinder 12*c*, in which exhaust strokes are not adjacent, and exhaust operations are not performed consecutively. Therefore, in an aspect of simplifying a structure, the exhaust ports 18 of the second cylinder 12*b* and the exhaust ports 18 of the third cylinder 12*c* are connected to a common independent exhaust pipe 5*b*. More specifically, the independent exhaust pipe 5*b* connected to the exhaust ports 18 of the second cylinder 12*b* and to the exhaust ports 18 of the third cylinder 12*c* is branched into two passages in an upstream portion of the exhaust manifold 4. The exhausts port 18 of the second cylinder 12*b* are connected to one of the two passages, and the exhaust ports 18 of the third cylinder 12*c* are connected to the other of the two passages.

In the embodiment, as also illustrated in FIG. 1, the independent exhaust pipe 5*b* associated with the second cylinder 12*b* and the third cylinder 12*c* linearly extends toward the mixing pipe 50 between the cylinders 12*b* and 12*c*, specifically, at a position facing a substantially middle portion of the engine body 1. The independent exhaust pipes 5*a* and 5*c* respectively associated with the first cylinder 12*a* and the fourth cylinder 12*d* extend toward the mixing pipe 50, while bending from positions facing the cylinders 12*a* and 12*d*.

These independent exhaust pipes 5*a*, 5*b*, and 5*c* (hereinafter, unless otherwise specifically required to distinguish the independent exhaust pipes one from another, these independent exhaust pipes 5*a*, 5*b*, and 5*c* may be simply referred to as "independent exhaust pipes 5") are independent of each other. Exhaust gas discharged from the second cylinder 12*b* or from the third cylinder 12*c*, exhaust gas discharged from the first cylinder 12*a*, and exhaust gas discharged from the fourth cylinder 12*d* are discharged downstream independently of each other through the independent exhaust pipes 5*a*, 5*b*, and 5*c*. Exhaust gas that has passed through the independent exhaust pipes 5*a*, 5*b*, and 5*c* flows into the straight portion 6 of the mixing pipe 50.

The independent exhaust pipes 5 and the straight portion 6 have a shape such that as exhaust gas is injected from the independent exhaust pipes 5 at a high speed, and the exhaust gas flows into the straight portion 6 at a high speed, a negative pressure is generated within the other one of the independent exhaust pipes 5 adjacent to one of the independent exhaust pipes 5 and within the exhaust ports 18 communicating with the other one of the independent exhaust pipes 5 by a negative pressure operation within the mixing pipe 50 that occurs in the periphery of the high-speed exhaust gas, specifically, by an ejector effect, and exhaust gas within the exhaust ports 18 is sucked downstream.

Figure 5:
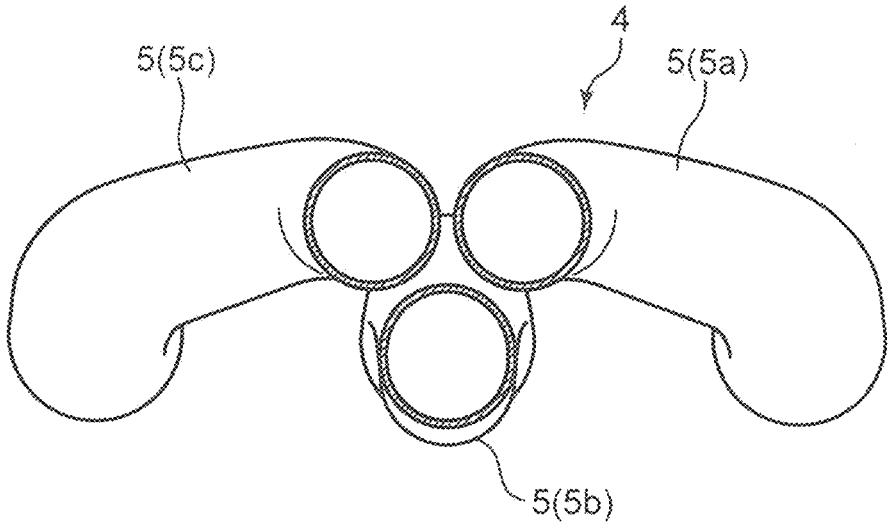
FIG. 5 is a cross-sectional view of the exhaust device taken along the line V-V in FIG. 2.

Further, downstream portions of the independent exhaust pipes 5 have a shape such that a flow channel area thereof (a flow channel area obtained by cutting a flow channel along a plane orthogonal to an exhaust gas flow direction) decreases toward downstream so as to inject exhaust gas into the straight portion 6 from the independent exhaust pipes 5 at a high speed. In the embodiment, as illustrated in FIG. 5, a cross section of an inner space of a downstream portion of each of the independent exhaust pipes 5, specifically, a cross section of an exhaust passage (a cross section obtained by cutting an exhaust passage along a plane orthogonal to an exhaust gas flow direction) has a substantially circular shape. A cross sectional area of the inner space gradually decreases toward downstream from an upstream portion of each of the independent exhaust pipes 5. A cross-sectional area (a flow channel area) of a downstream end of each of the independent exhaust pipes 5 is equal to about one-third of a cross-sectional area of an upstream end thereof.

Figure 6:
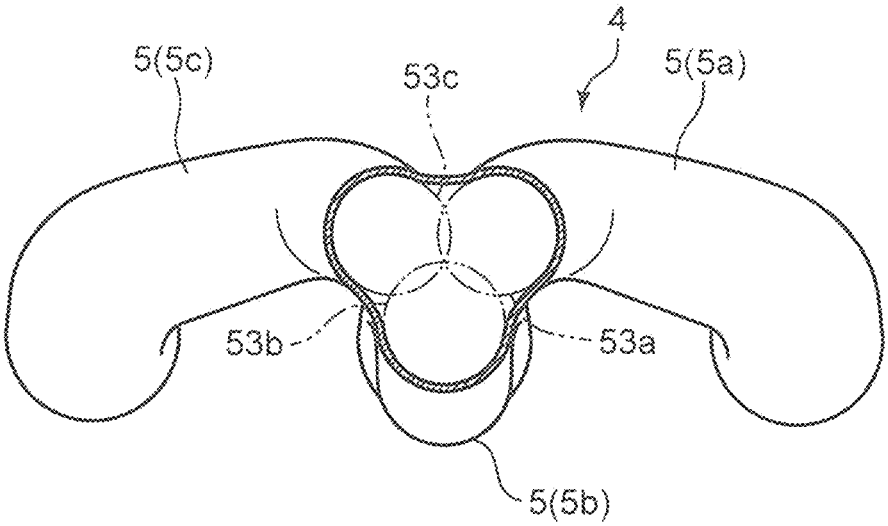
FIG. 6 is a cross-sectional view of the exhaust device taken along the line VI-VI in FIG. 2.
Figure 7:
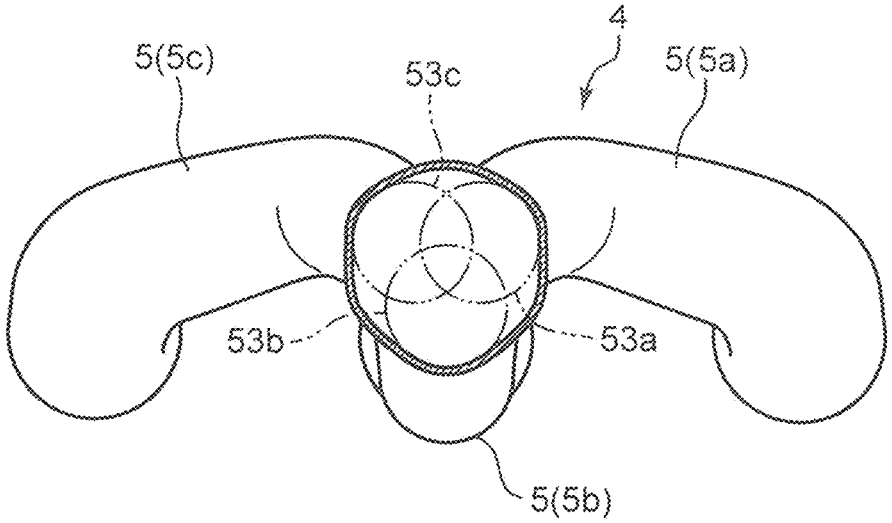
FIG. 7 is a cross-sectional view of the exhaust device taken along the line VII-VII in FIG. 2.
Figure 8:
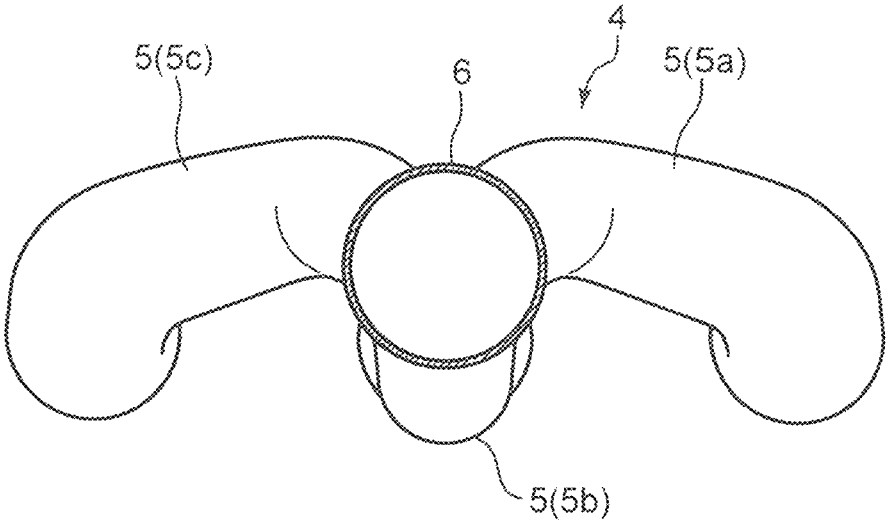
FIG. 8 is a cross-sectional view of the exhaust device taken along the line VIII-VIII in FIG. 2.

Further, as illustrated in FIG. 6 to FIG. 8, the independent exhaust pipes 5*a*, 5*b*, and 5*c* are connected to an upstream end of the straight portion 6 in such a manner that a part of an inner space 53*a* of a circular cross section of the independent exhaust pipe 5*a*, a part of an inner space 53*b* of a circular cross section of the independent exhaust pipe 5*b*, and a part of an inner space 53*c* of a circular cross section of the independent exhaust pipe 5*c* overlap each other in a predetermined section K1 (see FIG. 2) from the downstream ends of the independent exhaust pipes 5*a*, 5*b*, and 5*c* toward upstream, and a ratio of overlapping portions of the cross sections gradually increases from upstream toward downstream.

Figure 2:
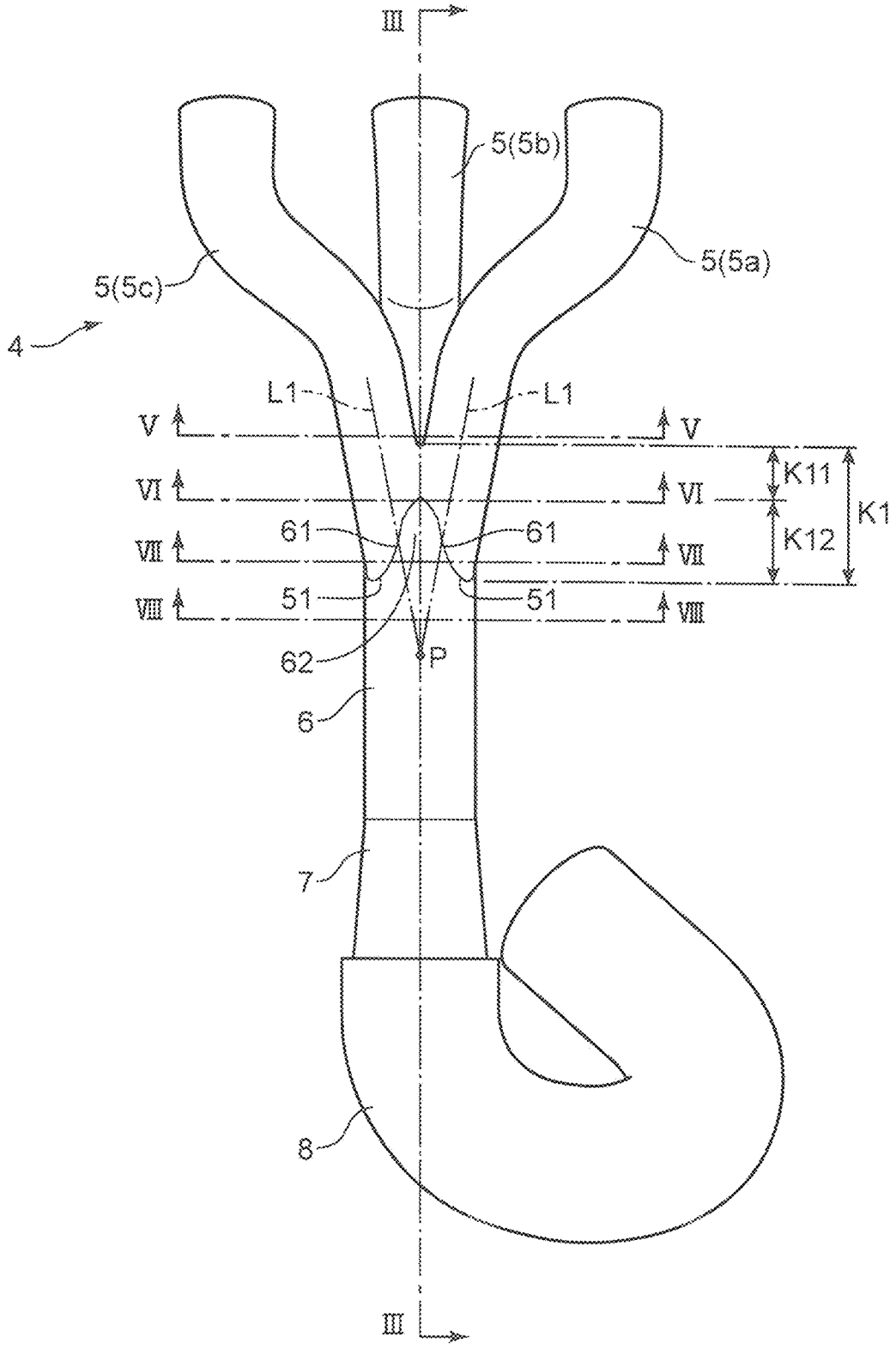
FIG. 2 is a plan view of the exhaust device.

The "inner space" described herein means a space surrounded by an inner peripheral surface of the independent exhaust pipe 5 in an area where a pipe wall of the independent exhaust pipe 5 is present over the entirety thereof circumferentially, and means a space surrounded by an entirety of an inner peripheral surface of a pipe wall of the independent exhaust pipe 5 in an area where the pipe wall of the independent exhaust pipe 5 is present partially circumferentially, specifically, in a case (see the two-dotted chain-lined-circles in FIG. 6 and FIG. 7) where a pipe wall is virtually expanded into a circular shape over the entirety thereof circumferentially in the section K1 illustrated in FIG. 2.

In the embodiment, as illustrated in FIG. 6, when an inner space is defined as described above, the inner space 53*a* of the independent exhaust pipe 5*a*, the inner space 53*b* of the independent exhaust pipe 5*b*, and the inner space 53*c* of the independent exhaust pipe 5*c* slightly overlap each other. The inner spaces 53*a*, 53*b*, and 53*c* illustrated in FIG. 6 indicate inner spaces in the vicinity of a cross section taken along the line VI-VI in FIG. 2. Further, as illustrated in FIG. 7, overlap areas of the inner space 53*a*, the inner space 53*b*, and the inner space 53*c* are larger than overlap areas illustrated in FIG. 6 on further downstream portions of the independent exhaust pipes 5*a*, 5*b*, and 5*c*. The inner spaces 53*a*, 53*b*, and 53*c* illustrated in FIG. 7 indicate inner spaces in the vicinity of a cross section taken along the line VII-VII in FIG. 2.

Figure 3:
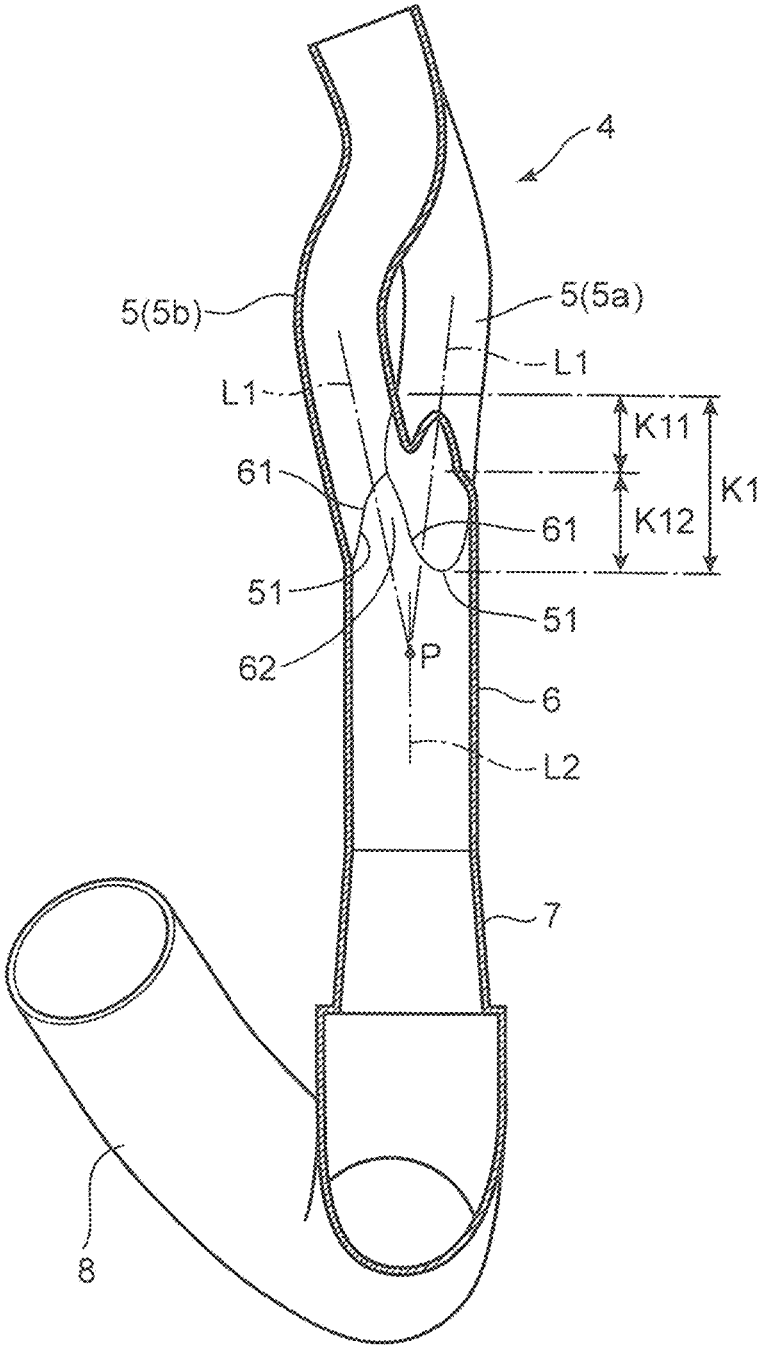
FIG. 3 is a cross-sectional view of the exhaust device taken along the line III-III in FIG. 2.
Figure 4:
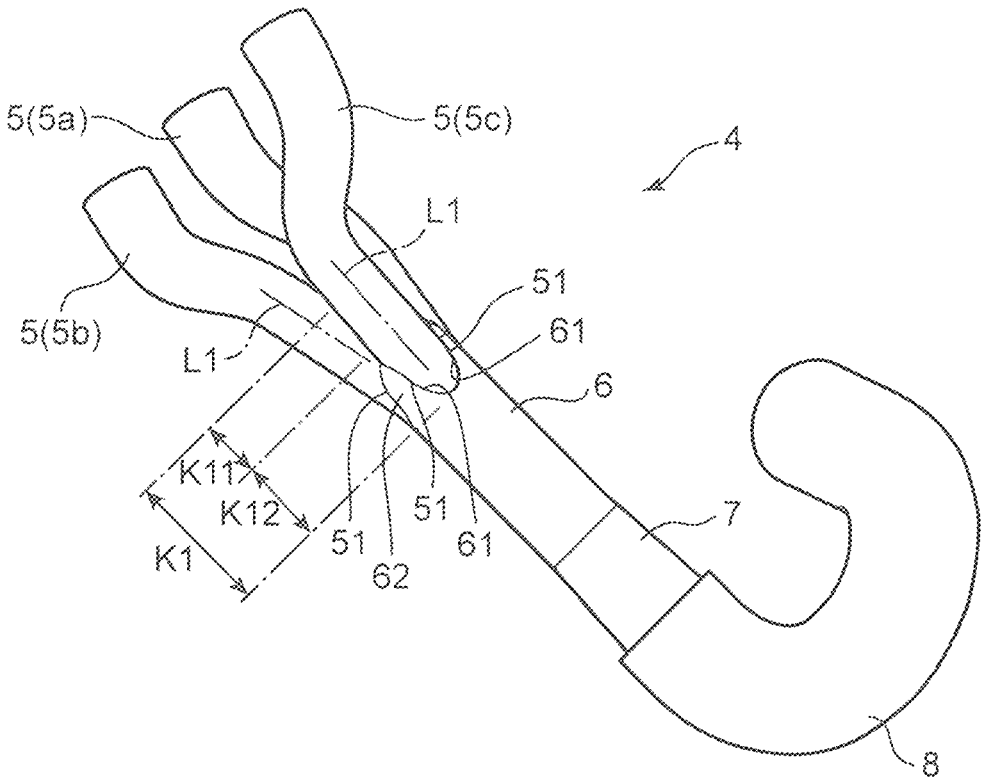
FIG. 4 is a side view of the exhaust device illustrated in FIG. 2.

More specifically, as illustrated in FIG. 2 to FIG. 4, each of the independent exhaust pipes 5 includes a downstream end surface 51 tilted with respect to an axis L1 thereof in the section K1 (hereinafter, referred to as the "overlap section K1") where parts of inner spaces overlap each other. The downstream end surface 51 has a shape such that a part of a pipe wall is cut out with an angle (e.g. an angle that defines an acute angle with respect to the axis L1) tilted with respect to the axis L1. In the embodiment, as illustrated in FIG. 3, the axes L1 of downstream portions of the independent exhaust pipes 5 intersect each other at one point P on an axis L2 of the straight portion 6. Further, in the embodiment, the overlap section K1 includes an upstream overlap section K11 on an upstream side in an exhaust gas flow direction, and a downstream overlap section K12 adjacent to the upstream overlap section K11 on a downstream side.

As illustrated in FIG. 2 and FIG. 3, in the upstream overlap section K11, the downstream end surfaces 51 of the independent exhaust pipes 5*a*, 5*b*, and 5*c* extend in a direction tilted with respect to the axes L1 thereof, and are joined to each other. As illustrated in FIG. 2 and FIG. 3, in the downstream overlap section K12, the downstream end surfaces 51 of the independent exhaust pipes 5*a*, 5*b*, and 5*c* are formed into a substantially U-shape projecting downstream, when viewed from the side of an outer peripheral surface of a pipe wall, and are disposed to face each other in a state that ends thereof are continued, and intermediate portions thereof are away from each other. According to this configuration, in the downstream overlap section K12, the downstream end surfaces 51 of the independent exhaust pipes 5*a*, 5*b*, and 5*c* are formed to have a wavy shape in its entirety, when viewed from the side of an outer peripheral surface of a pipe wall.

As illustrated in FIG. 2 to FIG. 4, in the downstream overlap section K12, the straight portion 6 has a shape such that circumferential parts (three parts) thereof project upstream in such a manner as to fill three gaps i.e. a gap between the independent exhaust pipe 5*a* and the independent exhaust pipe 5*b*, a gap between the independent exhaust pipe 5*b* and the independent exhaust pipe 5*c*, and a gap between the independent exhaust pipe 5*a* and the independent exhaust pipe 5*c*. Further, an upstream end surface 61 of a projecting portion 62 of the straight portion 6 is joined to the downstream end surfaces 51 of the independent exhaust pipes 5*a*, 5*b*, and 5*c*.

Next, operations and advantageous effects of the embodiment are described.

In the embodiment, exhaust gas flowing from the independent exhaust pipes 5 into the straight portion 6 merges within the straight portion 6, and the merged exhaust gas flows successively from the straight portion 6 to the diffuser portion 7 and to the downstream exhaust pipe 8.

As described above, in the embodiment, the independent exhaust pipes 5*a* to 5*c* are connected to an upstream end of the straight portion 6 in such a manner that a part of the inner space 53*a* of a circular cross section of the independent exhaust pipe 5*a*, a part of the inner space 53*b* of a circular cross section of the independent exhaust pipe 5*b*, and a part of the inner space 53*c* of a circular cross section of the independent exhaust pipe 5*c* overlap each other, and a ratio of overlapping portions of the circular cross sections gradually increases from upstream toward downstream. Therefore, exhaust gas discharged from the independent exhaust pipes 5 flows into the straight portion 6, while keeping a flow channel shape thereof being a substantially circular shape. Thus, exhaust gas flowing from the independent exhaust pipes 5 is substantially uniformly distributed within the entirety of the straight portion 6 having a circular cross section. Consequently, backflow of exhaust gas within the straight portion 6 from downstream is suppressed, as compared with a conventional art.

Figure 10:
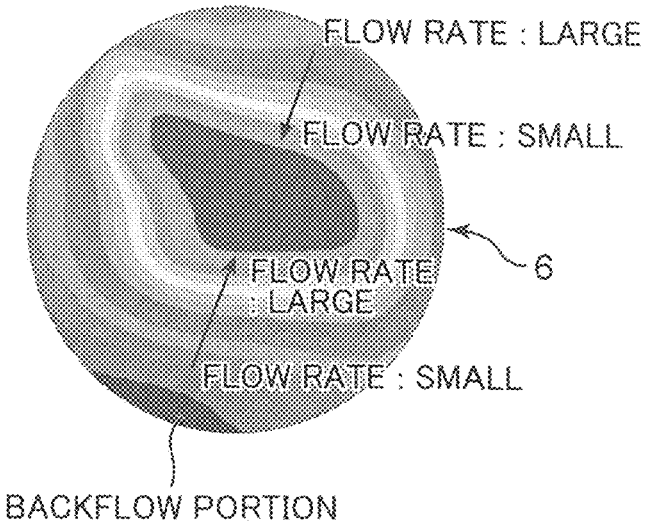
FIG. 10 is a diagram illustrating a flow rate distribution of exhaust gas in a straight portion of the exhaust device.
Figure 11:
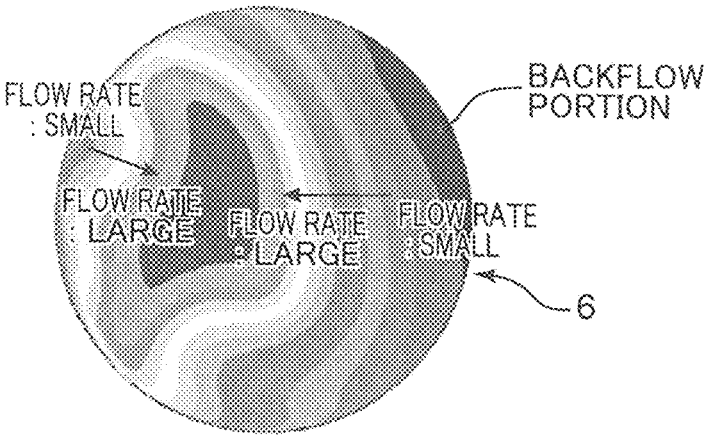
FIG. 11 is a diagram illustrating a flow rate distribution of exhaust gas in a straight portion of a conventional exhaust device.

FIG. 10 illustrates an example of a flow rate distribution of exhaust gas in the straight portion 6 of the exhaust device in the embodiment. FIG. 11 illustrates an example of a flow rate distribution of exhaust gas in a straight portion of a conventional exhaust device described in Patent Literature 1. As illustrated in FIG. 10, in the exhaust device of the embodiment, regarding exhaust gas flowing downstream (a portion other than a backflow portion illustrated in FIG. 10) within an inner space of the straight portion 6, an area of a portion where a flow rate is large is relatively large, and an area of a backflow portion of exhaust gas from downstream is relatively small. On the other hand, as illustrated in FIG. 11, regarding exhaust gas flowing downstream within an inner space of the straight portion of the conventional exhaust device, an area of a portion where a flow rate is large is relatively small, and an area of a backflow portion of exhaust gas from downstream is relatively large.

Figure 12:
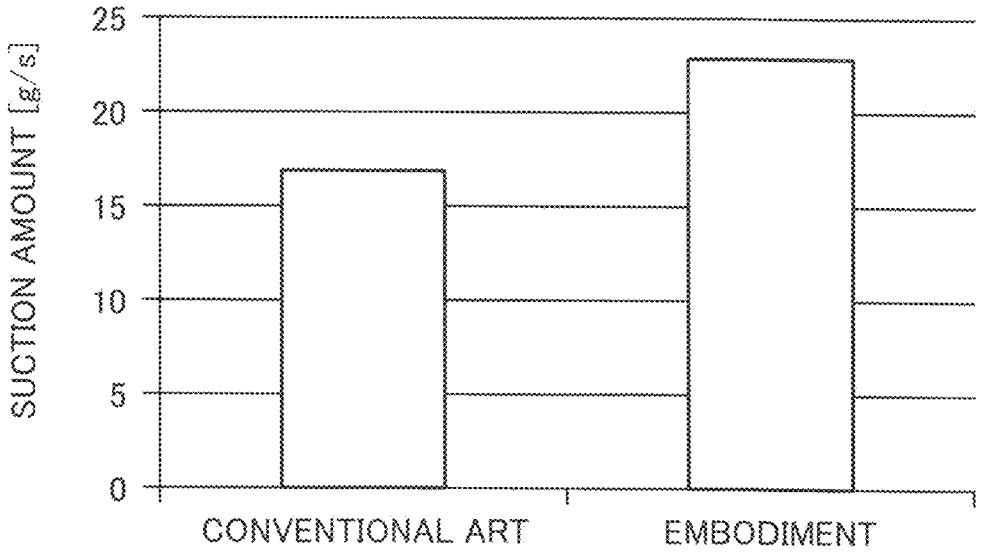
FIG. 12 is a graph illustrating a suction amount of exhaust gas by the conventional exhaust device, and a suction amount of exhaust gas by the exhaust device in the first embodiment.

Further, as illustrated in FIG. 12, a suction amount of exhaust gas by an ejector effect is large in the exhaust device of the embodiment, as compared with the conventional exhaust device.

Therefore, according to the embodiment, it is possible to advantageously enhance engine output by increasing a suction amount of exhaust gas from the independent exhaust pipes 5.

Second Embodiment

Next, a second embodiment is described with reference to FIG. 13 to FIG. 21. In the following description, same constituent elements as those in the first embodiment are indicated with same reference numerals, and repeated description thereof is omitted as necessary.

Figure 13:
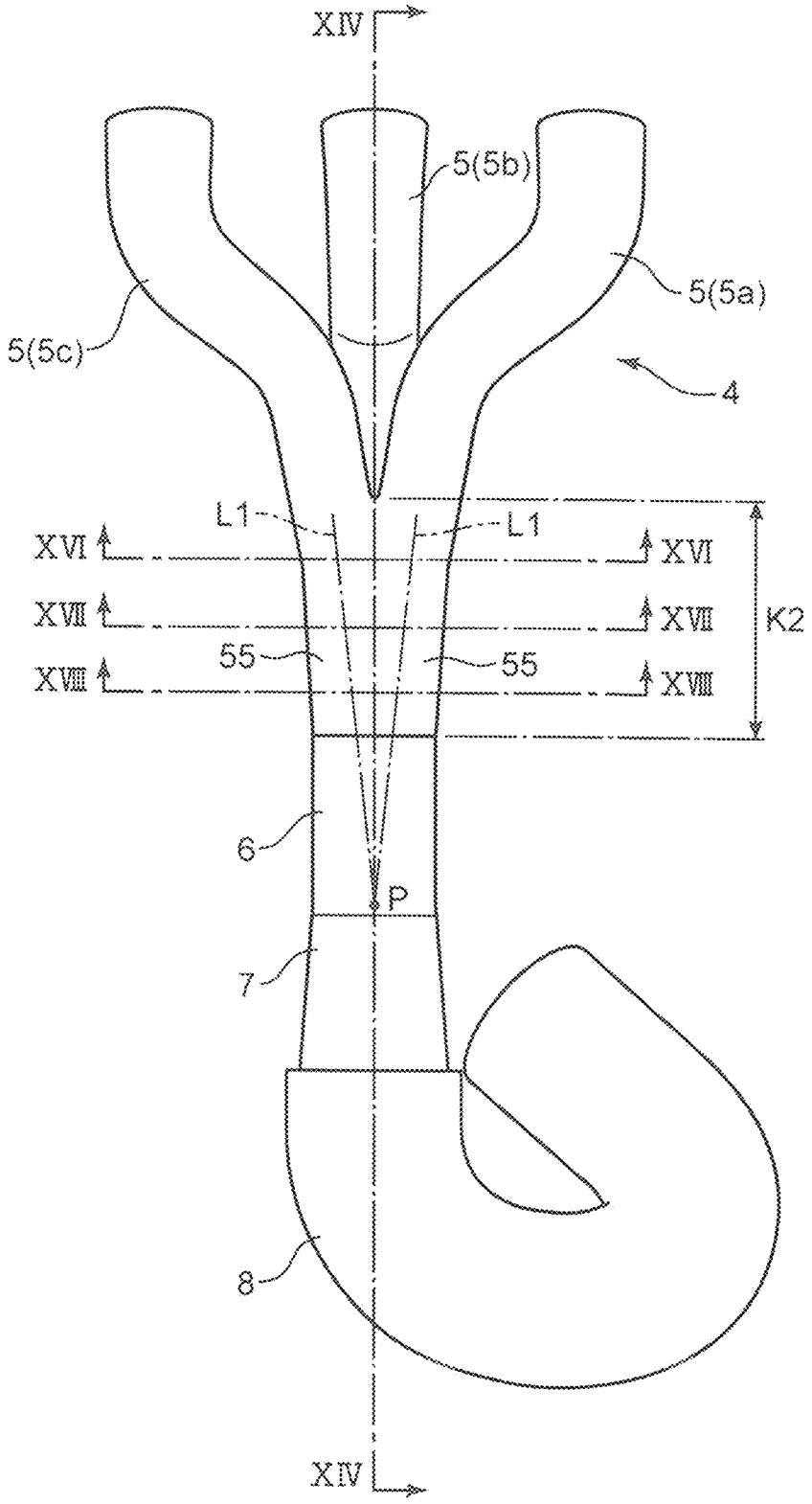
FIG. 13 is a plan view of an exhaust device of an engine according to a second embodiment of the present invention.
Figure 14:
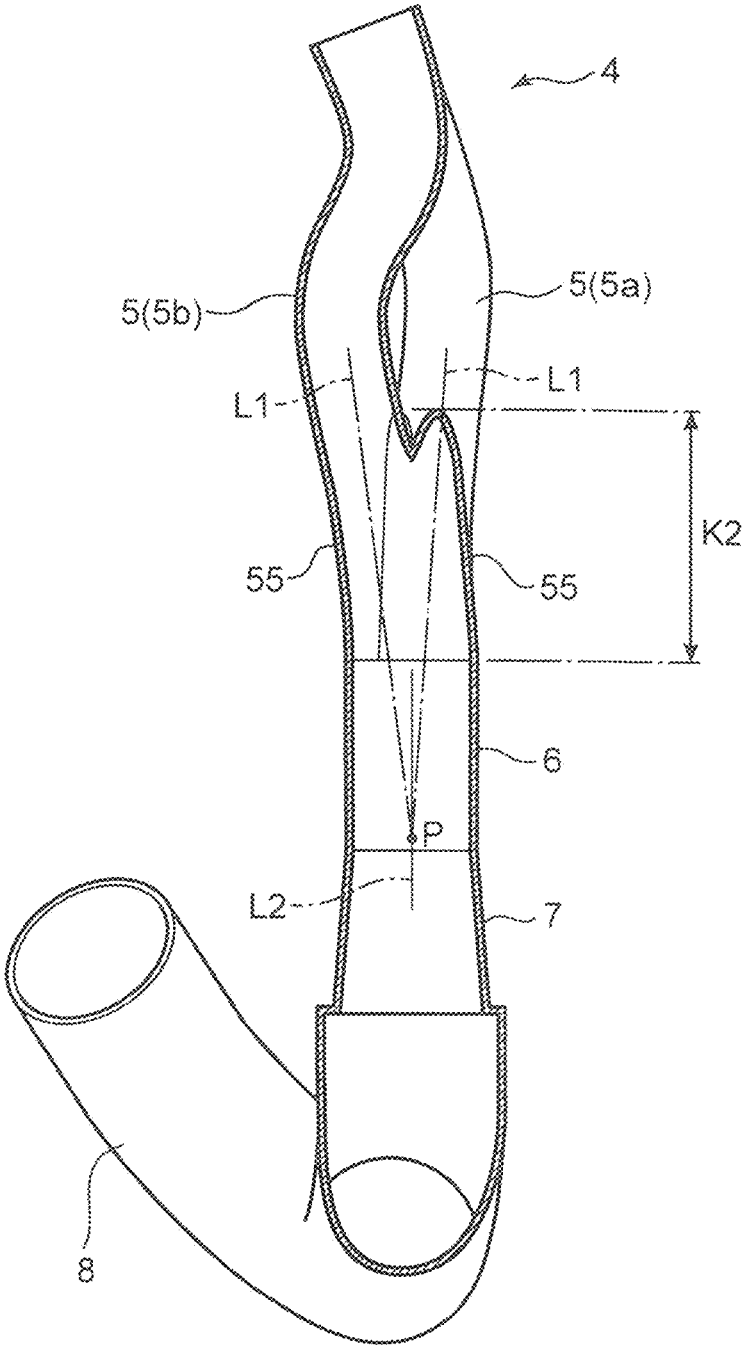
FIG. 14 is a cross-sectional view of the exhaust device taken along the line XIV-XIV in FIG. 13.
Figure 15:
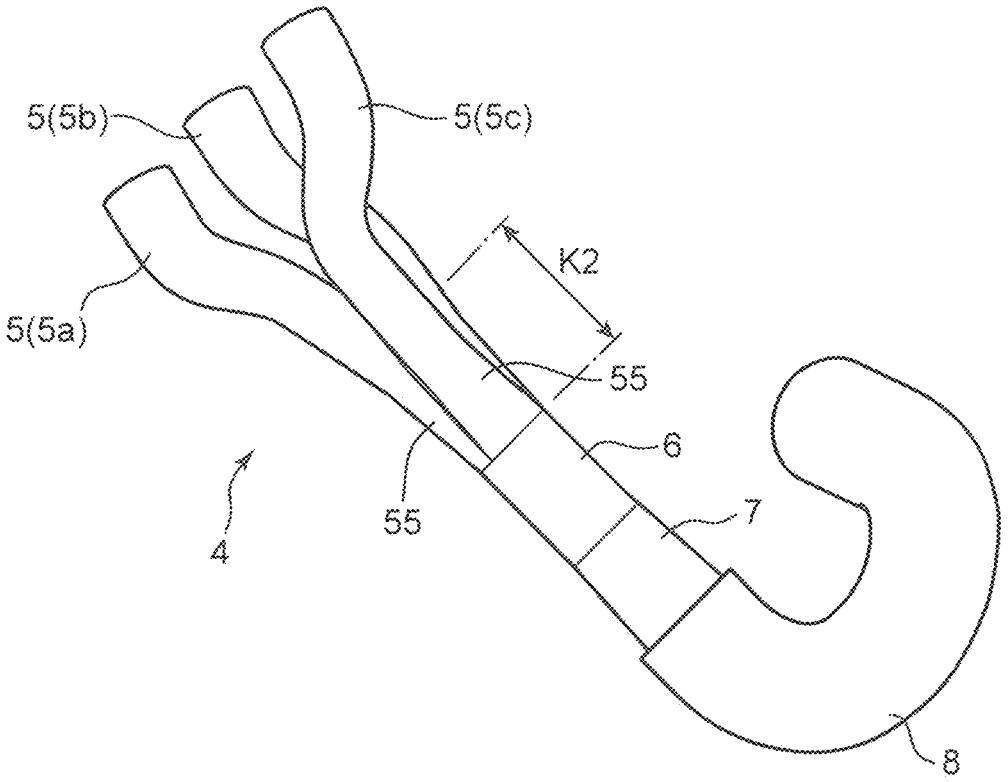
FIG. 15 is a side view of the exhaust device illustrated in FIG. 13.
Figure 16:
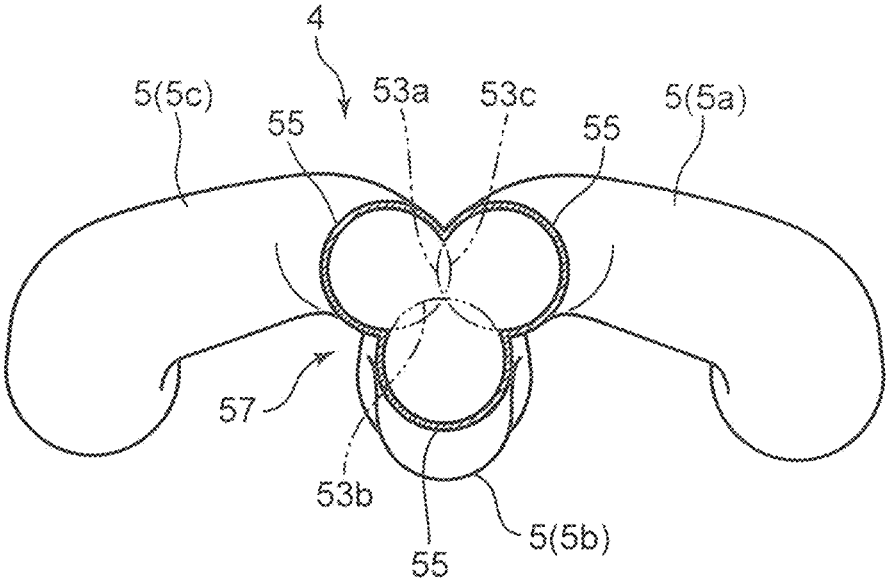
FIG. 16 is a cross-sectional view of the exhaust device taken along the line XVI-XVI in FIG. 13.
Figure 17:
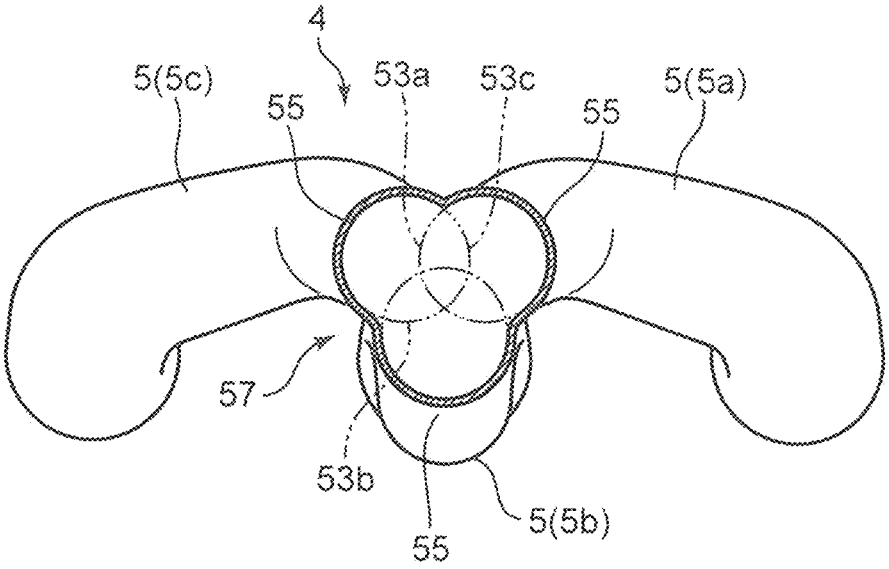
FIG. 17 is a cross-sectional view of the exhaust device taken along the line XVII-XVII in FIG. 13.
Figure 18:
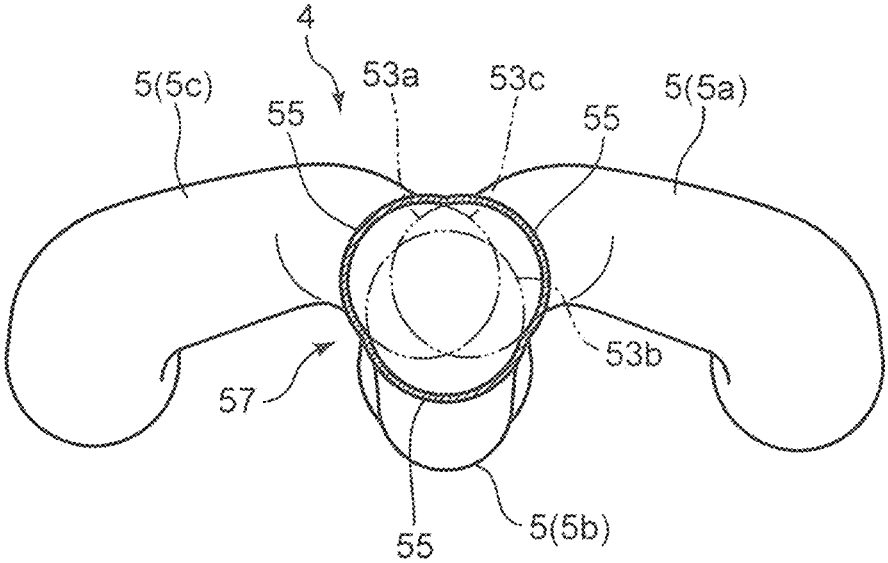
FIG. 18 is a cross-sectional view of the exhaust device taken along the line XVIII-XVIII in FIG. 13.
Figure 19:
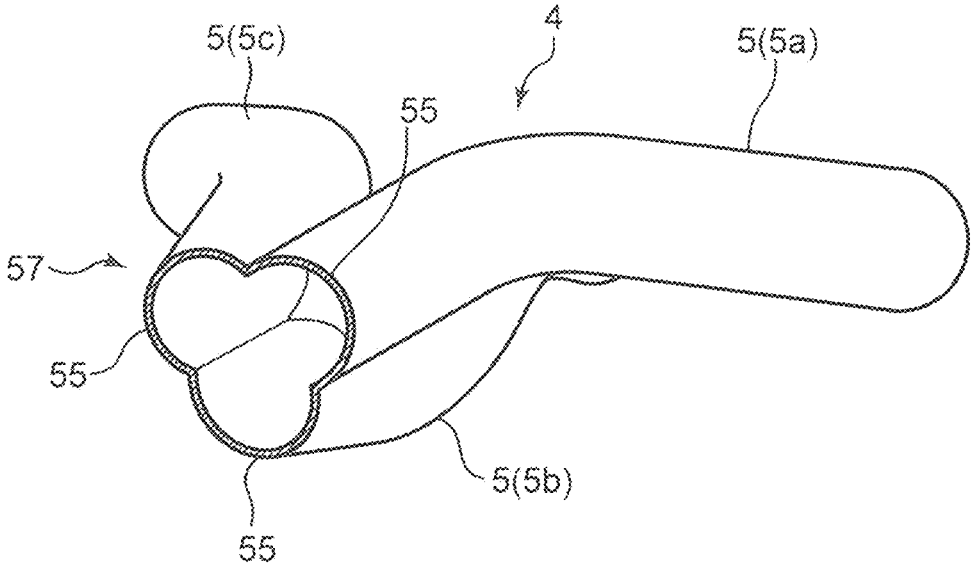
FIG. 19 is a cross-sectional view of the exhaust device illustrated in FIG. 16 when viewed from an oblique direction.
Figure 20:
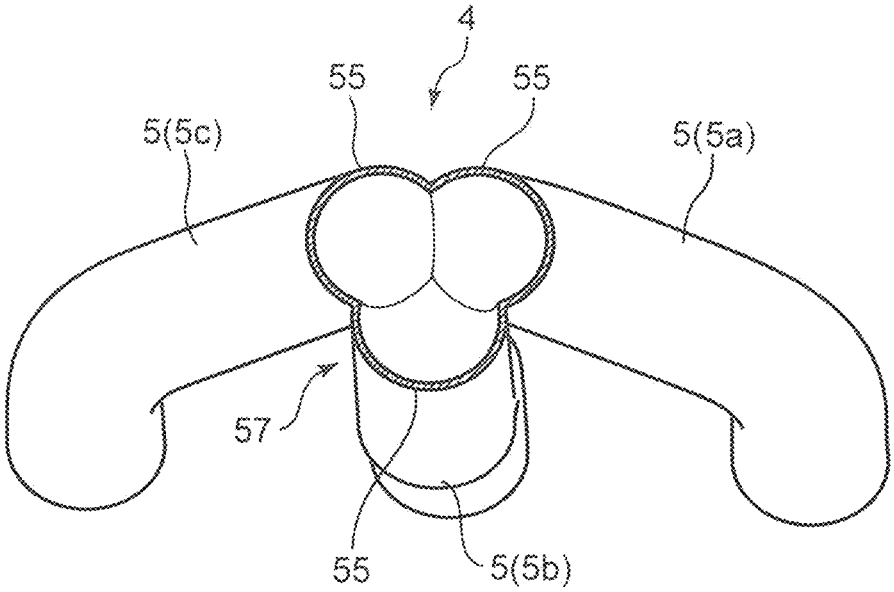
FIG. 20 is a cross-sectional view of the exhaust device illustrated in FIG. 16 when view from an oblique direction different from the direction of FIG. 19.
Figure 21:
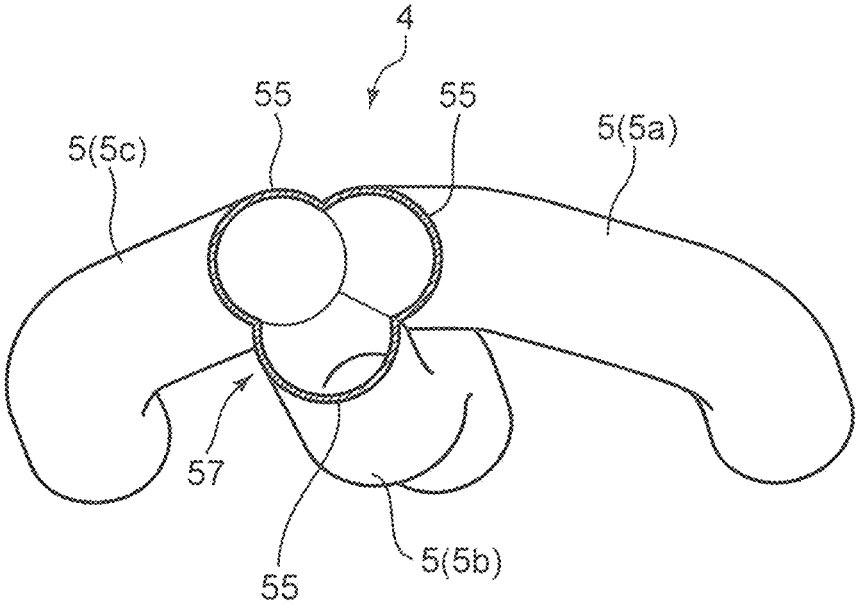
FIG. 21 is a cross-sectional view of the exhaust device illustrated in FIG. 16 when viewed from an oblique direction different from the directions of FIG. 19 and FIG. 20.
Figure 22:
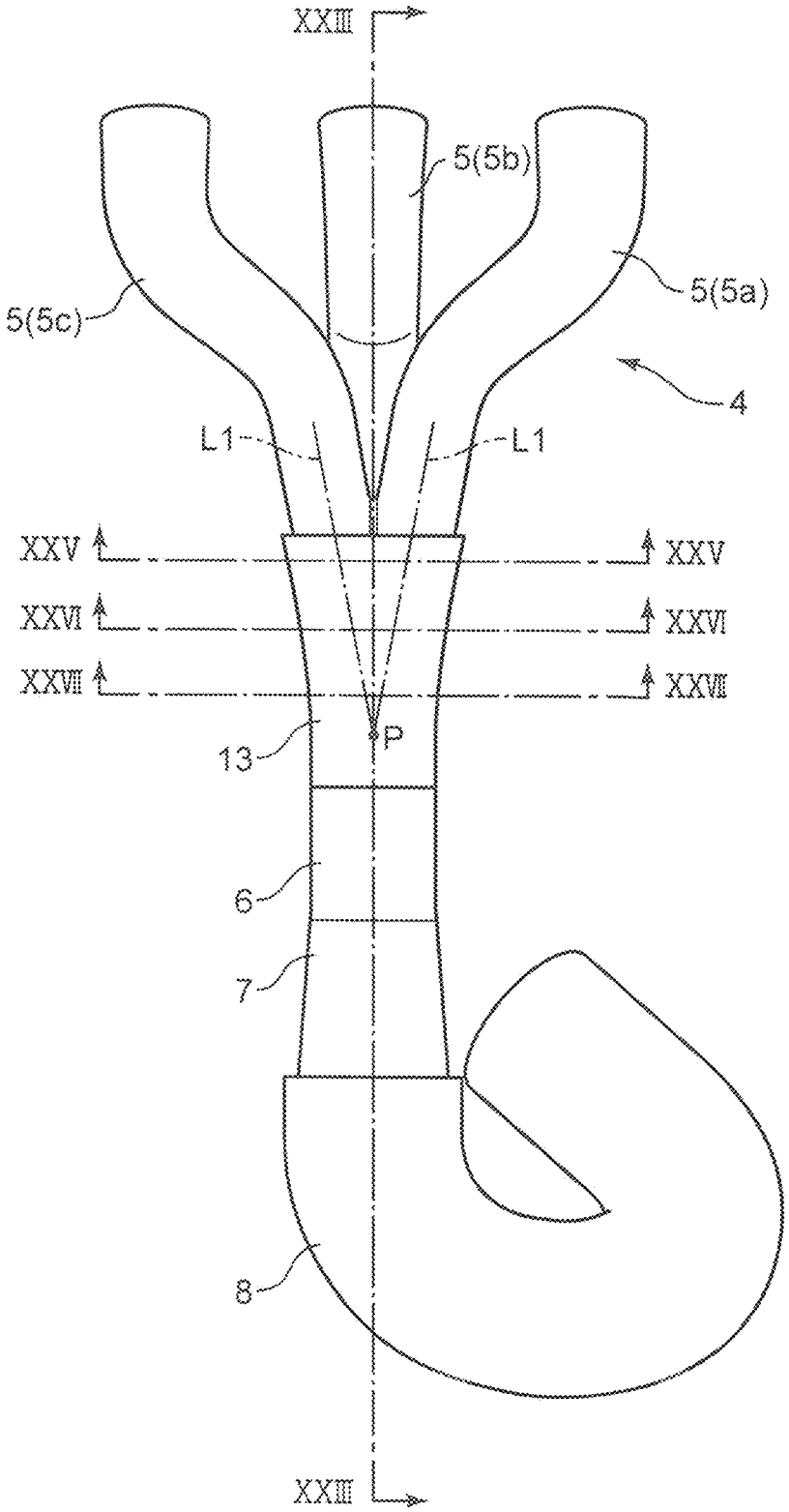
FIG. 22 is a plan view of an exhaust device of an engine according to a third embodiment of the present invention.

In the embodiment, as illustrated in FIG. 16 to FIG. 18, independent exhaust pipes 5*a*, 5*b*, and 5*c* are connected to an upstream end of a straight portion 6 in such a manner that, in a predetermined section K2 (see FIG. 13. Hereinafter, the section is referred to as an "overlap section K2") from downstream ends of the independent exhaust pipes 5*a*, 5*b*, and 5*c* toward upstream, a part of an inner space 53*a* of a circular cross section of the independent exhaust pipe 5*a*, a part of an inner space 53*b* of a circular cross section of the independent exhaust pipe 5*b*, and a part of an inner space 53*c* of a circular cross section of the independent exhaust pipe 5*c* overlap each other, and a ratio of overlapping portions of the circular cross sections gradually increases from upstream toward downstream in the overlap section K2. In the embodiment, as illustrated in FIG. 14, axes L1 of downstream portions of the independent exhaust pipes 5 intersect each other at one point P on an axis L2 of the straight portion 6.

Specifically, in the embodiment, as illustrated in FIG. 16, the inner space 53*a*, the inner space 53*b*, and the inner space 53*c* slightly overlap each other. The inner spaces 53*a*, 53*b*, and 53*c* illustrated in FIG. 16 indicate inner spaces in the vicinity of a cross section taken along the line XIV-XIV in FIG. 13. In order to easily understand a structure of the independent exhaust pipes 5*a*, 5*b*, and 5*c* illustrated in FIG. 16, FIG. 19 to FIG. 21 are perspective views of the independent exhaust pipes 5 illustrated in FIG. 16 when viewed from an oblique direction by changing viewing directions. Further, as illustrated in FIG. 17, regarding further downstream portions of the independent exhaust pipes 5, overlap areas between the inner space 53*a*, the inner space 53*b*, and the inner space 53*c* are large, as compared with overlap areas illustrated in FIG. 16. The inner spaces 53*a*, 53*b*, and 53*c* illustrated in FIG. 17 indicate inner spaces in the vicinity of a cross section taken along the line XVII-XVII in FIG. 13. Further, as illustrated in FIG. 18, regarding furthermore downstream portions of the independent exhaust pipes 5, overlap areas between the inner space 53*a*, the inner space 53*b*, and the inner space 53*c* are large, as compared with overlap areas illustrated in FIG. 17. The inner spaces 53*a*, 53*b*, and 53*c* illustrated in FIG. 18 indicate inner spaces in the vicinity of a cross section taken along the line XVIII-XVIII in FIG. 13.

More specifically, as illustrated in FIG. 16 to FIG. 18, each of the independent exhaust pipes 5*a*, 5*b*, and 5*c* includes a pipe wall 55 of an arc shape when viewed from an axis L1 thereof in the overlap section K2. Further, an irregular (non-round) peripheral wall 57 including a plurality of bulging portions (i.e. the arc-shaped pipe walls 55) when viewed from the axis L1 is formed by joining peripheral ends of the pipe walls 55 of the independent exhaust pipes 5*a*, 5*b*, and 5*c* to each other. Further, the irregular peripheral wall 57 is connected to an upstream end of the straight portion 6 in such a manner that a cross section thereof in a direction orthogonal to an axis direction thereof is gradually formed into a shape analogous to a circular shape from upstream toward downstream in a state that a downstream end of the irregular peripheral wall 57 has a circular shape of a same diameter as a diameter of an upstream end of the straight portion 6. In the embodiment, the peripheral walls 55 of the independent exhaust pipes 5*a*, 5*b*, and 5*c* are configured such that a diameter of each of the peripheral walls 55 gradually increases in the overlap section K2 (see the two-dotted chain-lined circles in FIG. 16 to FIG. 18). Further, as illustrated in FIG. 16 to FIG. 18, an angle defined by tangential lines with respect to outer peripheral surfaces of the peripheral walls 55 gradually decreases toward downstream in a joint portion of the adjacent peripheral walls 55.

The straight portion 6 in the embodiment has a structure, in which the projecting portion 62 in the first embodiment is removed, and an upper end surface of the straight portion 6 has a circular shape.

Also in the embodiment, as well as the first embodiment, exhaust gas discharged from the independent exhaust pipes 5 flows into the straight portion 6, while keeping a flow channel shape thereof being a substantially circular shape. Thus, exhaust gas flowing in from the independent exhaust pipes 5 is distributed substantially uniformly within the entirety of the straight portion 6 having a circular cross section. Consequently, backflow of exhaust gas within the straight portion 6 from downstream is suppressed, as compared with the conventional exhaust device. Thus, it is possible to advantageously enhance engine output by increasing a suction amount of exhaust gas from the independent exhaust pipes 5.

Third Embodiment

A third embodiment of the present invention is described with reference to FIG. 22 to FIG. 27. In the following description, same constituent elements as those in the first embodiment are indicated with same reference numerals, and repeated description thereof is omitted as necessary.

In the embodiment, a mixing pipe 50 includes, on an axis thereof, a frustoconical portion 13, a straight portion 6, and a diffuser portion 7 in this order from the upstream side thereof. The frustoconical portion 13 extends downstream, and is configured such that a flow channel area thereof decreases toward downstream. The diffuser portion 7 is configured such that a flow channel area thereof increases toward downstream.

Figure 25:
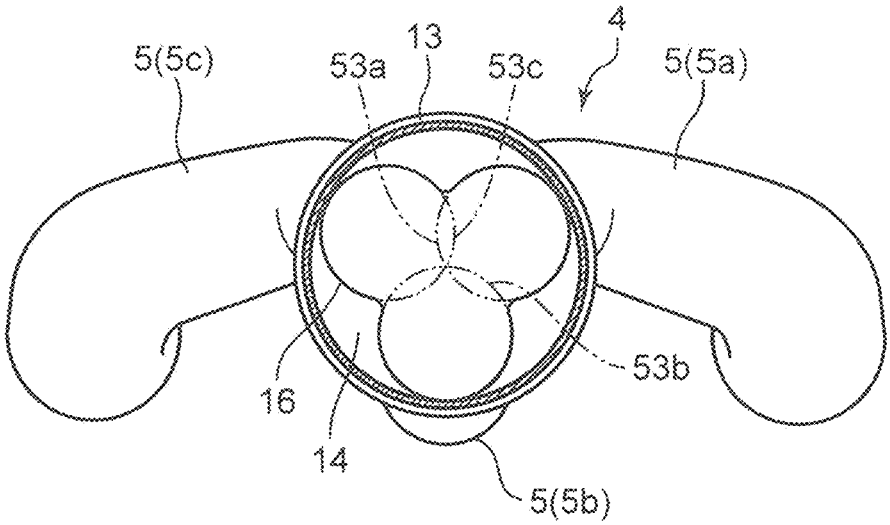
FIG. 25 is a cross-sectional view of the exhaust device taken along the line XXV-XXV in FIG. 22.
Figure 26:
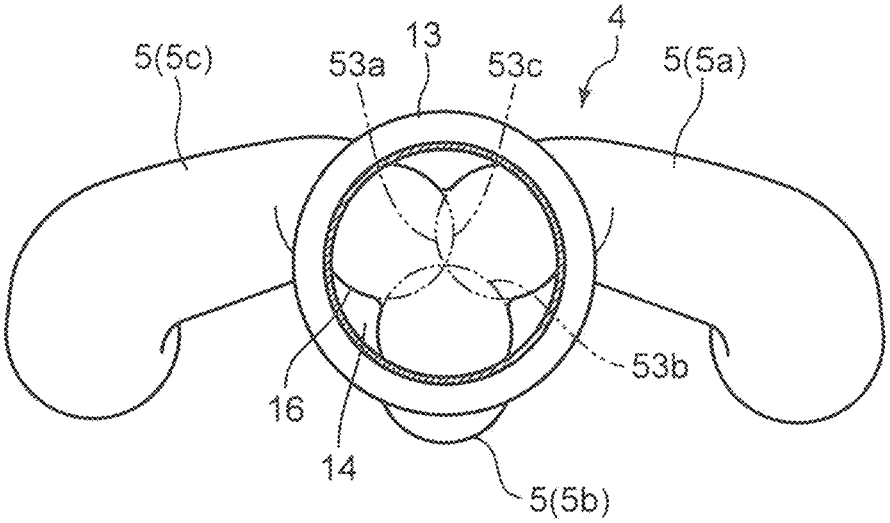
FIG. 26 is a cross-sectional view of the exhaust device taken along the line XXVI-XXVI in FIG. 22.
Figure 27:
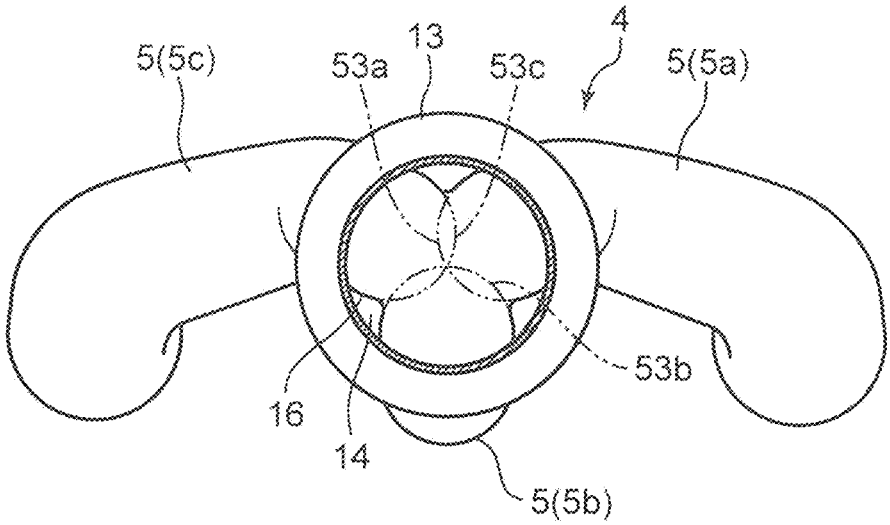
FIG. 27 is a cross-sectional view of the exhaust device taken along the line XXVII-XXVII in FIG. 22.

The frustoconical portion 13 has a disc-shaped end wall portion 14 (see FIG. 23) on an upstream end thereof. Further, downstream ends of independent exhaust pipes 5 are connected to an opening portion 16 formed in the end wall portion 14. As illustrated in FIG. 25 to FIG. 27, the opening portion 16 has a shape such that three arc-shaped end portions which are aligned circumferentially around a center of the end wall portion 14 are connected to each other. In the embodiment, as illustrated in FIG. 23, axes L1 of downstream portions of the independent exhaust pipes 5 intersect each other at one point P on an axis L3 of the frustoconical portion 13.

Figure 23:
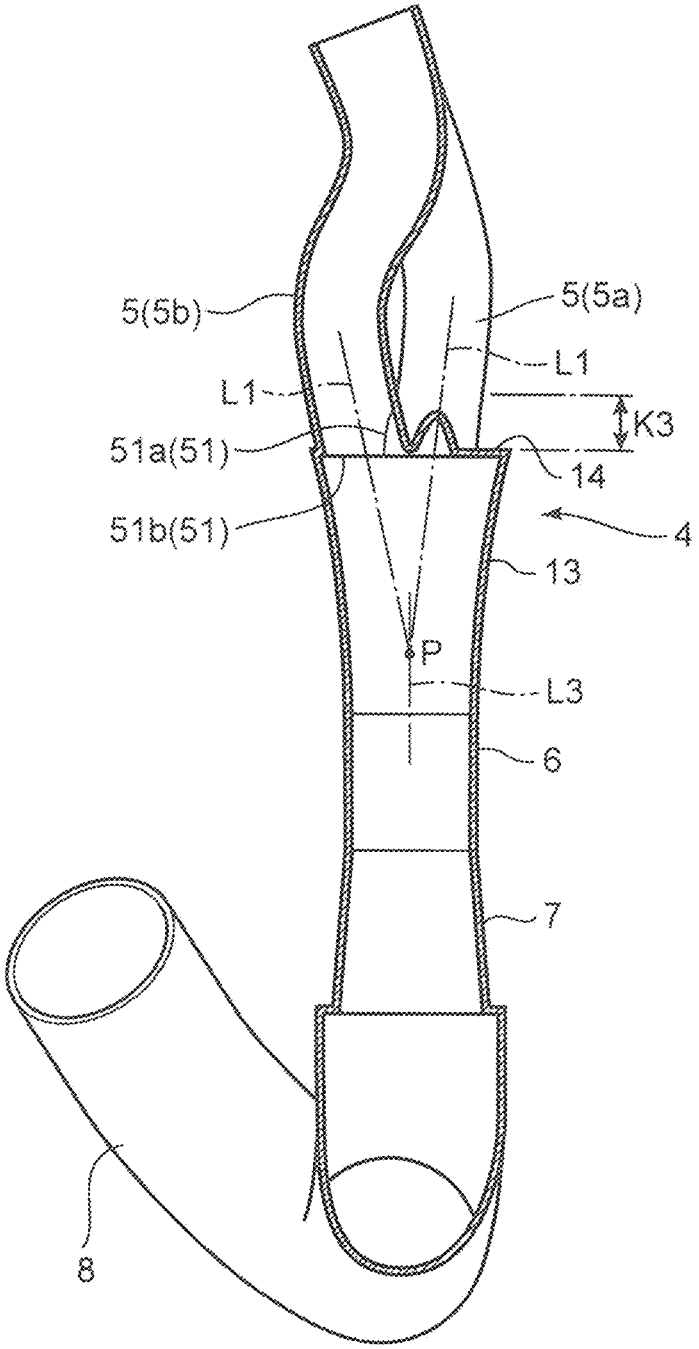
FIG. 23 is a cross-sectional view of the exhaust device taken along the line XXIII-XXIII in FIG. 22.
Figure 24:
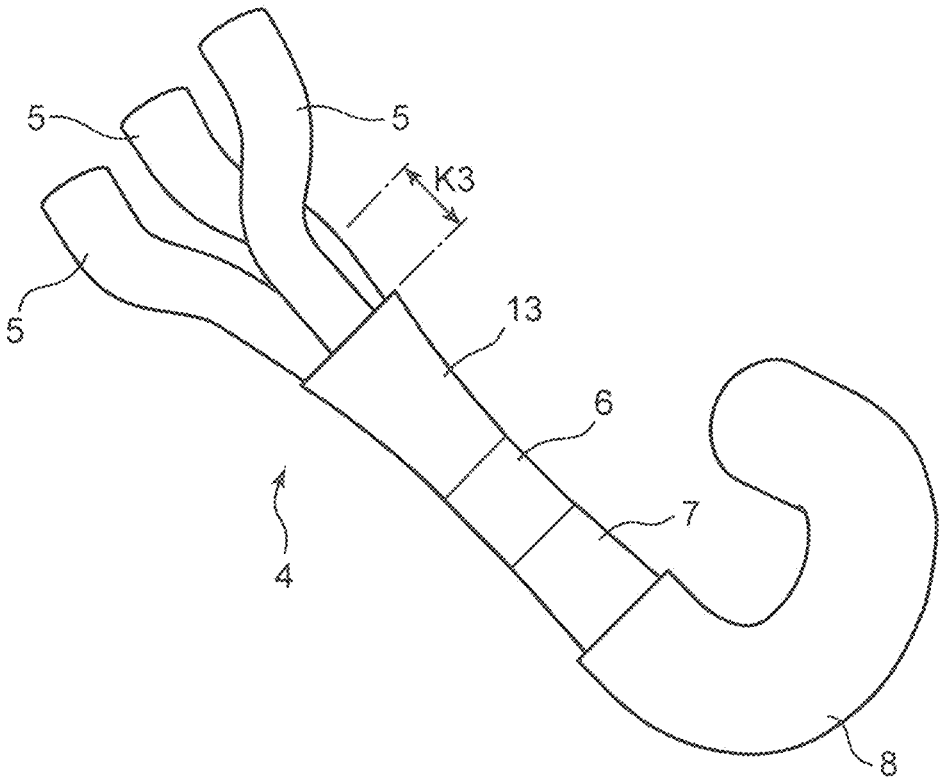
FIG. 24 is a side view of the exhaust device of the engine illustrated in FIG. 22.

In the embodiment, independent exhaust pipes 5*a*, 5*b*, and 5*c* are connected to an upstream end of the frustoconical portion 13 in such a manner that, in a predetermined section K3 (see FIG. 23. Hereinafter, the section is referred to as an "overlap section K3") from downstream ends of the independent exhaust pipes 5*a*, 5*b*, and 5*c* toward upstream, a part of an inner space 53*a* of a circular cross section of the independent exhaust pipe 5*a*, a part of an inner space 53*b* of a circular cross section of the independent exhaust pipe 5*b*, and a part of an inner space 53*c* of a circular cross section of the independent exhaust pipe 5*c* overlap each other, and a ratio of overlapping portions of the circular cross sections gradually increases from upstream toward downstream in the overlap section K3.

Specifically, as illustrated in FIG. 23, in the overlap section K3, a downstream end surface 51 of each of the independent exhaust pipes 5*a*, 5*b*, and 5*c* includes a portion 51*a* obtained by cutting out the downstream end surface 51 along a plane tilted with respect to an axis L1 and joining the cutout portions to each other, and a portion 51*b* to be joined to the frustoconical portion 13.

In the embodiment, exhaust gas discharged from the independent exhaust pipes 5 flows into the frustoconical portion 13 and is mixed within the frustoconical portion 13, while keeping a flow channel shape thereof being a substantially circular shape. The mixed exhaust gas flows into the straight portion 6 having a circular cross section, while keeping a flow channel shape thereof being a substantially circular shape, and is distributed substantially uniformly within the entirety of the straight portion 6. Consequently, backflow of exhaust gas within the straight portion 6 from downstream is suppressed, as compared with the conventional art. Thus, it is possible to advantageously enhance engine output by increasing a suction amount of exhaust gas from the independent exhaust pipes 5.

The aforementioned embodiments are applied to a 4-cylinder engine. The present invention, however, is not limited to the above. The present invention is also applicable to a 6-cylinder engine, an 8-cylinder engine, and the like.

The following is a summary of the present invention as described above.

The present invention is directed to an exhaust device connected to an engine body of an engine having a plurality of cylinders. The exhaust device includes a plurality of independent exhaust pipes, each of which has a circular cross section, the independent exhaust pipes being respectively connected to exhaust ports of the cylinders of the engine body or to exhaust ports of ones of the plurality of cylinders, in which exhaust operations are not performed consecutively; and a mixing pipe having a circular cross section, connected to downstream ends of the independent exhaust pipes, and through which exhaust gas that has passed through the independent exhaust pipes flows in. The independent exhaust pipes are connected to an upstream end of the mixing pipe in such a manner that parts of inner spaces of the circular cross sections overlap each other in a predetermined section from the downstream ends of the independent exhaust pipes toward upstream, and a ratio of overlapping portions of the circular cross sections gradually increases from upstream toward downstream.

According to the present invention, exhaust gas discharged from the independent exhaust pipes flows into the mixing pipe, while keeping a flow channel shape thereof being a substantially circular shape. Therefore, exhaust gas flowing in from the independent exhaust pipes is distributed substantially uniformly within the entirety of the mixing pipe having a circular cross section. Consequently, backflow of exhaust gas from downstream is suppressed, and it is possible to enhance engine output by increasing a suction amount of exhaust gas from the independent exhaust pipes.

In the present invention, preferably, the mixing pipe may include a gathering portion where exhaust gas flowing in from the independent exhaust pipes gathers, and the gathering portion may have a same inner diameter over an entirety thereof in an axis direction thereof.

According to the aforementioned configuration, it is possible to securely and uniformly distribute exhaust gas flowing in from the independent exhaust pipes within the gathering portion of the mixing pipe having a same inner diameter over the entirety thereof in the axis direction. This is advantageous in suppressing backflow of exhaust gas from downstream.

In the present invention, preferably, each of the independent exhaust pipes may include a downstream end surface tilted with respect to an axis thereof in the section where the parts of the inner spaces overlap each other. The independent exhaust pipes may be disposed in such a manner that the downstream end surfaces face each other. An upstream end of the mixing pipe may have a shape such that a circumferential part thereof projects upstream in such a manner that a gap between the downstream end surfaces facing each other is filled. The downstream end surface of each of the independent exhaust pipes, and the upstream end of the mixing pipe may be joined to each other.

According to the aforementioned configuration, it is possible to form the downstream ends of the independent exhaust pipes and the upstream end of the gathering portion with a relatively simplified structure, and it is possible to manufacture the exhaust device relatively easily.

Preferably, each of the independent exhaust pipes may include a pipe wall of an arc shape when viewed from an axis thereof in the section where the parts of the inner spaces overlap each other. An irregular peripheral wall including a plurality of bulging portions when viewed from a side of the mixing pipe may be formed on the independent exhaust pipes by joining peripheral ends of the pipe walls to each other. The irregular peripheral wall may be connected to an upstream end of the mixing pipe in such a manner that a cross section of the irregular peripheral wall in a direction orthogonal to an axis direction thereof is gradually formed into a shape analogous to a circular shape from upstream toward downstream in a state that a downstream end of the irregular peripheral wall has a circular shape of a same diameter as a diameter of the upstream end of the mixing pipe.

According to the aforementioned configuration, it is possible to flow exhaust gas from the independent exhaust pipes to the mixing pipe more smoothly.

The invention claimed is:

1. An exhaust device of a multiple-cylinder engine, the exhaust device connected to an engine body of the engine including a four cylinder arrangement in a straight line, comprising:

three independent exhaust pipes including two independent exhaust pipes each of which has a circular cross section, and which respectively communicate with exhaust ports of the cylinders at both ends of the four cylinder arrangement, and an independent exhaust pipe which has a circular cross section and has upstream ends respectively communicating with exhaust ports of the other two cylinders than the cylinders at the both ends; and a mixing pipe having a circular cross section, connected to downstream ends of the three independent exhaust pipes, and through which exhaust gas that has passed through the three independent exhaust pipes flows in, wherein the three independent exhaust pipes are connected to an upstream end of the mixing pipe in such a manner that inner spaces of the circular cross sections overlap each other in a predetermined section from the downstream ends of the three independent exhaust pipes toward the upstream end of the mixing pipe, and a ratio of overlapping portions of the circular cross sections gradually increases from upstream toward downstream.

2. The exhaust device of the multiple-cylinder engine according to claim 1, wherein the mixing pipe includes a gathering portion where exhaust gas flowing in from the three independent exhaust pipes gathers, and the gathering portion has a same inner diameter over an entirety thereof in an axis direction thereof.

3. The exhaust device of the multiple-cylinder engine according to claim 1, wherein each of the three independent exhaust pipes includes a downstream end surface tilted with respect to an axis thereof in the section where the inner spaces overlap each other, and the three independent exhaust pipes are disposed in such a manner that the downstream end surfaces face each other, the upstream end of the mixing pipe has a shape such that a circumferential part thereof projects upstream in such a manner that a gap between the downstream end surfaces facing each other is filled, and the downstream end surface of each of the three independent exhaust pipes, and the upstream end of the mixing pipe are joined to each other.

4. The exhaust device of the multiple-cylinder engine according to claim 1, wherein each of the three independent exhaust pipes includes a pipe wall of an arc shape when viewed from an axis thereof in the section where the inner spaces overlap each other, an irregular peripheral wall including a plurality of bulging portions when viewed from a side of the mixing pipe is formed on the three independent exhaust pipes by joining peripheral ends of the pipe walls to each other, and the irregular peripheral wall is connected to the upstream end of the mixing pipe in such a manner that a cross section of the irregular peripheral wall in a direction orthogonal to an axis direction thereof is gradually formed into a shape analogous to a circular shape from upstream toward downstream in a state that a downstream end of the irregular peripheral wall has a circular shape of a same diameter as a diameter of the upstream end of the mixing pipe.

* * * * *